United States Patent [19]

Shortell

[11] 4,162,546

[45] Jul. 31, 1979

[54] BRANCH TAIL PIECE

[75] Inventor: Kenneth R. Shortell, Cincinnati, Ohio

[73] Assignee: Carrcraft Manufacturing Company, Cincinnati, Ohio

[21] Appl. No.: 847,097

[22] Filed: Oct. 31, 1977

[51] Int. Cl.[2] ..... E03D 9/04

[52] U.S. Cl. ..... 4/191; 4/211; 137/604; 138/37

[58] Field of Search ..... 138/37, 178, 38, 39, 138/40, 42; 4/191, 211, 197, 206, 207; 137/604, 247; 285/153, 154

[56] References Cited

U.S. PATENT DOCUMENTS 933,279 9/1909 Welch ..... 138/37

2,141,797 12/1938 Minella ..... 138/37

3,894,302 7/1975 Lasater ..... 4/191

FOREIGN PATENT DOCUMENTS 2264 of 1896 United Kingdom ..... 138/37

*Primary Examiner*—Houston S. Bell, Jr.

*Attorney, Agent, or Firm*—Melville, Strasser, Foster & Hoffman

[57] ABSTRACT

A branch tail piece for connecting the waste water outlet of an automatic dishwasher or the like to a sink drain system. The tail piece includes an inclined branch member and a curved baffle positioned within the tail piece for preventing waste water from the dishwasher from entering the sink strainer.

11 Claims, 6 Drawing Figures

BRANCH TAIL PIECE

BACKGROUND OF THE INVENTION

1. Field of the Invention

The apparatus of the present invention relates generally to plumbing fixtures and more particularly to a branch tail piece having an internal baffle.

2. Description of the Prior Art

In the plumbing field, it is well known to provide a tail piece for connecting a sink drain system to another source of incoming waste water, such as a garbage disposer or an automatic dishwasher. Such tail pieces are generally T-shaped and include couplings for securing the tail piece to the lower end of a sink strainer and a conduit leading from the waste water source. In addition, the tail piece often includes means at its lower end for mating with a P-trap or the like.

It has been found that such prior art tail pieces may permit waste water injected under pressure, as from an automatic dishwasher or the like, to be expelled from the sink strainer. This condition may present a health hazard when the dirty waste water contacts food or clean kitchen ware adjacent the sink. In addition, the waste water flow may be such that the sink is filled more quickly than it can be emptied by the drain, resulting in messy overflows.

SUMMARY OF THE INVENTION

The present invention overcomes the aforementioned drawbacks, among others, of prior art branch tail pieces, by providing a curved baffle positioned within the tail piece which prevents waste water from entering the sink strainer. The curvature of the baffle is such so as to direct the flow of waste water away from the sink strainer end of the tail piece and toward the lower or P-trap end. In addition, the branch section of the tail piece is inclined to also assist the flow of waste water toward the lower end of the tail piece.

The sink strainer end of the tail piece may contain threaded or force-fit connections for coupling the tail piece to the lower end of the sink strainer. Likewise, the inlet end of the branch portion may be provided with threads or integral annular sealing ribs for attaching the branch to a flexible hose or other conduit leading from the automatic dishwasher.

DESCRIPTION OF THE PREFERRED EMBODIMENTS

Figures 1, 2, 3, 4:
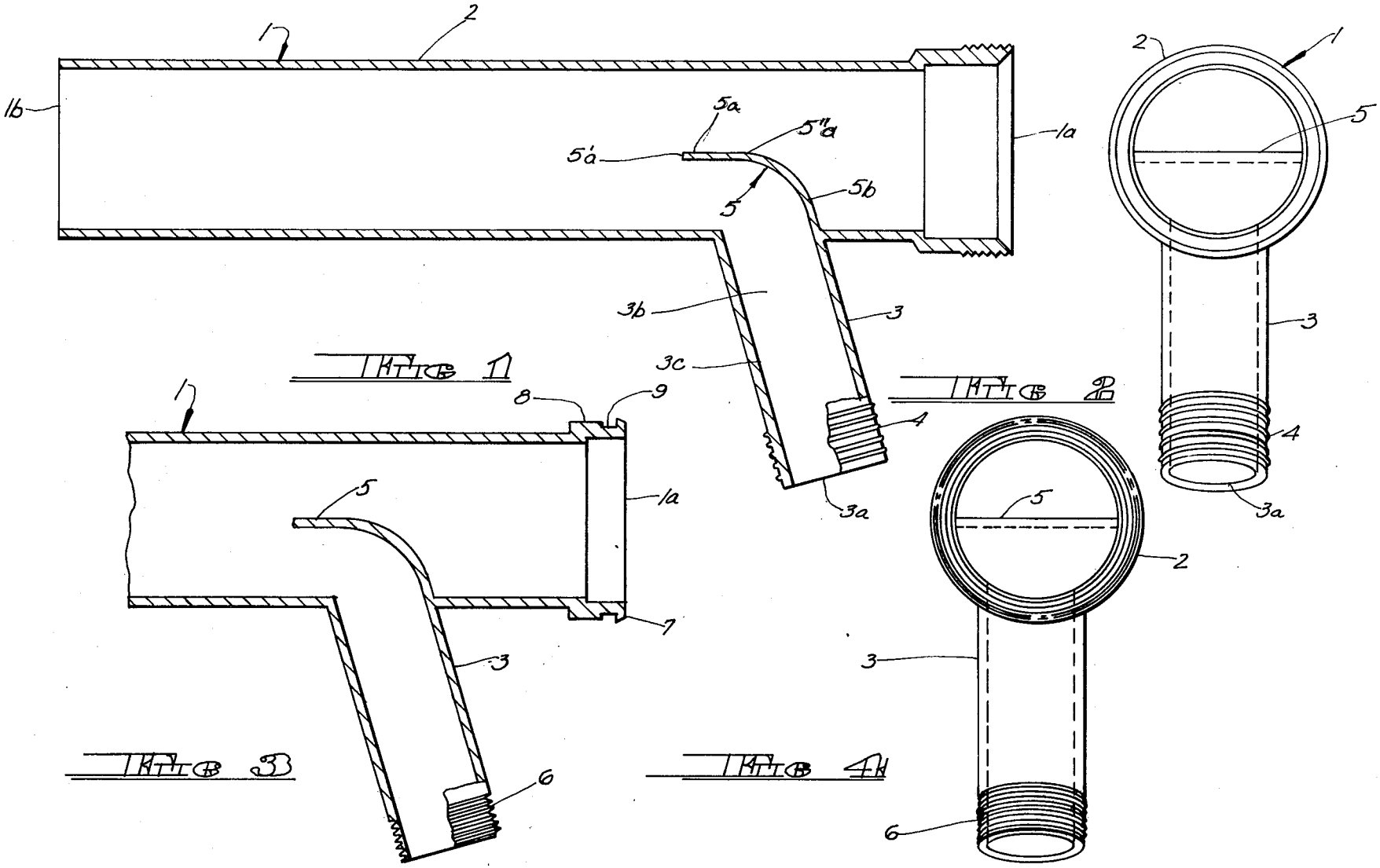
FIG. 1 is a side elevation view, partially in cross-section, of a first embodiment of the branch tail piece of the present invention.
FIG. 2 is an end view of the tail piece of FIG. 1.
FIG. 3 is a fragmentary side elevation view, partially in cross-section, of a second embodiment of the branch tail piece of the present invention.
FIG. 4 is an end view of the tail piece of FIG. 3.

A first embodiment of the branch tail piece of the present invention is shown, generally at 1, in FIG. 1. In actual operation, tail piece 1 would be positioned vertically such that the upper end 1*a* of the tail piece would be coupled to a suitable sink strainer (not shown) as is well understood in the art, while the lower end 1*b* of the tail piece would be connected to a P-trap or the like (not shown), as is also well understood in the art. Tail piece 1 is generally of thin walled tubular construction and may be fabricated from any suitable metallic, plastic or rubber material capable of withstanding the temperatures and chemical compositions normally associated with sink waste waters. In particular, it is preferred that tail piece 1 be constructed of a material which can be injected molded, such as acrylonitrile-butadiene styrene (ABS), polyvinyl chloride (PVC) or polypropylene, which insures an integral and leakproof design. This type of construction also avoids drawbacks encountered with prior art tail pieces which may require adhesive or mechanical bonds between various parts of the tail piece.

As can be seen in FIG. 1, tail piece 1 comprises a hollow tubular body portion 2 with an externally threaded coupling located at the upper end 1*a* of the tail piece. The interior of upper end 1*a* is so dimensioned as to accept the mating part of a typical sink strainer (not shown) as is well understood in the art.

The lower end of body portion 2 is provided with a smooth uninterrupted wall for providing a slip-fit coupling to a P-trap or the like (not shown) as is also well understood in the art.

The tail piece also includes a hollow tubular branch member 3 extending outwardly from body portion 2 such that the interior of branch member 3 communicates with the interior of body portion 2. Branch portion 3 is inclined such that the angle formed by the intersection of the axis of the branch member and the body portion is less than 90°. In other words, when branch tail piece 1 is installed in its normal vertical operative position, branch member 3 slopes downwardly toward body portion 2. This inclination of branch member 2 insures that waste water flow through branch member 3 is directed toward the lower end 1*b* of body portion 2 and away from the upper or sink strainer engaging end 1*a* of body portion 2. While branch member 3 may be inclined with respect to body portion 2 at substantially any angle, it has been found that certain angular relationships provide optimum performance, as will be discussed in more detail hereinafter.

The inlet port 3*a* of branch member 3 is so sized as to accept a suitable flexible conduit or the like (not shown) connecting the waste water outlet of a dishwasher to the branch tail piece. A series of spaced integral annular sealing ribs, one of which is shown at 4, may be provided adjacent inlet port 3*a* for providing a nonslip coupling for the flexible conduit. Additional coupling integrity may be provided by means of a hose clamp, or the like as is well understood in the art. The outlet port 3*b* of branch member 3 communicates directly with the hollow interior of body portion 2.

A baffle 5 is located within body portion 2 adjacent and spaced from outlet port 3*b* and branch member 3. Baffle 5 forms a channeled flow path to direct waste water flowing through branch member 3 away from the upper sink strainer engaging end 1*a* of tail piece 1, as will be explained in more detail hereinafter. In general, baffle 5 comprises a planar portion 5*a* extending chordwise completely across the interior of body portion 2. The exact placement of planar portion 5*a* within the tail piece will depend upon the relative quantities of water expected to flow into tail piece 1 from branch member 3 and from the sink strainer coupled to upper end 1*a* of the tail piece. In one particular application, it has been found that the amount of waste water entering tail piece 1 through branch member 3 is slightly less than the amount of waste water entering tail piece 1 from the sink strainer associated with the upper end 1*a* of the tail piece. Under this condition, excellent performance is obtained when the planar portion 5*a* is positioned slightly to the branch member side of body portion 2. It will also be observed that the lower edge 5*a'* of planar portion 5*a* extends slightly beyond the line of inner surface 3*c* of branch member 3 projected inwardly toward planar portion 5*a*. This insures that all waste water flowing in branch member 3 will contact and be directed by baffle 5.

Attached to the upper edge 5*a''* of planar portion 5*a* is an arcuate portion 5*d* extending completely across the inside of body portion 2 and attached to the inner surface of body portion 2 between outlet port 3*b* of branch member 3 and the upper or sink strainer engaging end 1*a* of branch tail piece 1. Arcuate portion 5*b* is so shaped as to direct waste water flowing out of outlet port 3*b* toward the lower end 1*b* of branch tail piece 1. It will be understood that body portion 2, branch member 3 and baffle 5 may be formed of separate pieces joined by any conventional means, or may be of integral one-piece construction, this latter method being preferred to insure a leak-proof configuration.

As described hereinabove, it is preferred that the branch member 3 be inclined at an acute angle with respect to body portion 2. It is clear that the minimum resistance to flow in branch member 3 will occur when the axis of branch member 3 and body portion 2 are substantially parallel. However, this type of construction has generally proved unacceptable. For angles of inclination greater than zero (parallelism), it may also be observed that the area of the opening presented by outlet port 3*b* decreases for a constant branch member size. It has been found that optimum performance is obtained when the cross sectional area presented by the outlet end of the channeled flow path formed by baffle 5 is larger than the cross sectional area of branch member 3. This construction insures minimum hydraulic resistance to the flow in branch member 3, and minimizes flow turbulence which has been found to result in undesirable "sucking" noises which eminate from the sink strainer. Thus for smaller inclination angles of branch member 3, which lead to greater cross sectional areas for outlet port 3*b*, greater opening must be provided between planar portion 5*a* of baffle 5 and the inner wall of body portion 2 supporting branch member 3. The relative positioning of baffle 5 within body portion 2, as described hereinabove, is dependent on the relative quantity of flow issuing from branch member 3 and introduced into the upper end 1*a* of branch tail piece 1. For a typical 1½ inch diameter tail piece having a ⅞ inch diameter branch member, excellent results have been obtained with a baffle positioned at approximately the center line of body portion 2 and with an inclination angle of approximately 16° for branch member 3.

It will be understood that branch member 3 may be positioned at any point along the outside surface of body portion 2 to insure convenient coupling to flexible hoses or the like attached to an automatic dishwasher, provided that sufficient distance is provided between the flow exit from baffle 5 and the upper sink strainer engaging end 1*a* of tail piece 1 to insure that no waste water is expelled from the sink strainer. The baffle 5 will deflect downwardly the hot waste from the dishwasher and dissipate the heat, thus protecting the body portion of the tail piece from damage. For the typical tail piece parameters described above, it has been found that locating branch member 3 at a position approximately ¼ the length of tail piece 1 gives excellent results.

FIG. 3 and FIG. 4 depict a second embodiment of the branch tail piece of the present invention similar to that described in connection with the embodiment of FIG. 1 and FIG. 2, but with different types of coupling mechanisms provided for the sink strainer and the dishwasher hose coupling. In this embodiment, coupling 6 associated with branch member 3 is threaded for mating with a matching thread on the dishwasher flexible hose coupling, rather than the integral annular sealing ribs of the embodiment of FIGS. 1 and 2. Similarily, coupling 7 associated with the upper or sink strainer engaging end 1*a* of tail piece 1 comprises a direct nut capture force fit coupling for use with a captured nut sink strainer fitting. This construction includes an annular flange 8 circumferentially disposed about the outer surface of the upper end of body portion 2. An annular groove is disposed within flange 8 for accepting a snap-action captured nut (not shown) commonly associated with a typical sink strainer.

Figures 5, 6:
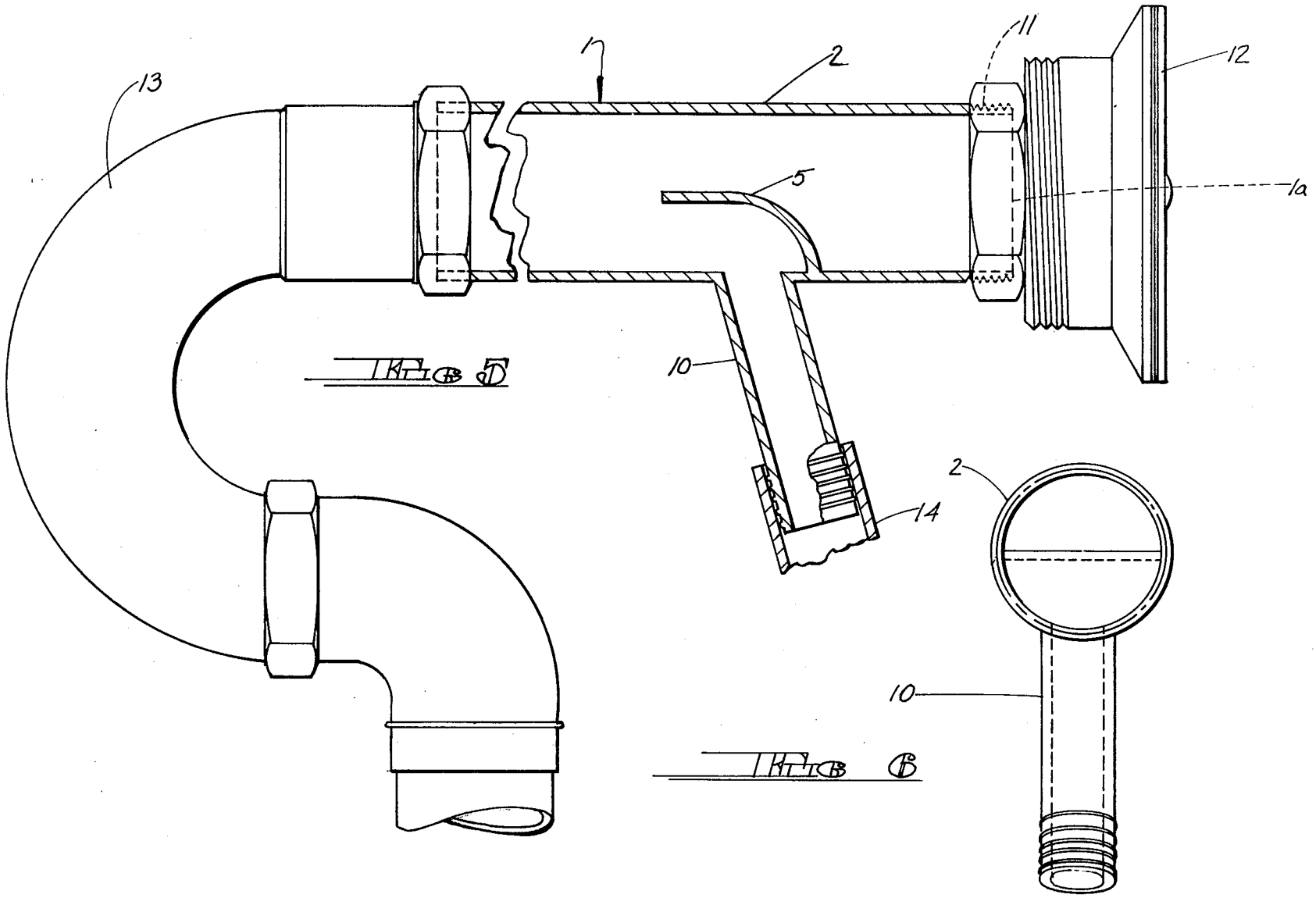
FIG. 5 is a fragmentary side elevation view, partially in cross-section, of a third embodiment of the branch tail piece shown attached to a typical sink strainer and P-trap.
FIG. 6 is an end view of the tail piece of FIG. 5.

FIG. 5 and FIG. 6 illustrate a third embodiment of the tail piece of the present invention, containing the general configuration of the embodiment of FIG. 1 and FIG. 2, shown connected to a typical sink strainer 12, P-trap 13, and dishwasher drain hose 14. However, in this configuration the branch member, which has been assigned index numberal 10, to differentiate it from the branch member 3 of the embodiment of FIG. 1 and FIG. 2, is of a slightly smaller diameter in order to accomodate a smaller dishwasher waste water hose. As can be readily seen, branch member 10 is so positioned with respect to baffle 5 that all waste water issuing from branch member 10 impinges upon and is directed by baffle 5. The embodiment of FIGS. 5 and 6 also contains an externally threaded portion 11 located at the upper or sink strainer engaging end 1*a* of tail piece 1 which is adapted to directly engage a threaded captured nut associated with the sink strainer.

It will be understood that various changes in the details, materials, steps and arrangements of parts, which have been herein described and illustrated in order to explain the nature of the invention, may be made by those skilled in the art within the principle and scope of the invention as expressed in the appended claims. For example, while for purposes of an exemplary showing the tail piece of the present invention has been described with specific types of couplings associated with branch member and the sink strainer engaging end of the tail piece, it will be understood that other types of couplings or combinations of couplings may be utilized as required in particular circumstances.

The embodiments of the invention in which a property or privilege is claimed are as follows:

1. A branch tail piece for connecting the waste water outlet of an automatic dishwasher or the like to a waste drain system having a sink strainer and a trap, said tail piece comprising a hollow tubular body portion having an upper sink strainer engaging end including means for coupling said tail piece to the sink strainer and a lower trap engaging end adapted to engage the trap, a hollow tubular branch member extending outwardly from said body portion and having an inlet port and an outlet port, said outlet port communicating with the interior of said body portion, said branch member including means for coupling said inlet port to the waste water outlet of the automatic dishwasher or the like, and a baffle located within said body portion adjacent said outlet port of said branch member to provide a channeled flow path for directing the flow of the waste water within said tail piece to prevent the waste water from being expelled from said sink strainer engaging end of said tail piece, said baffle comprising a planar portion and an arcuate portion, said planar portion extending chordwise across the interior of said body portion, the lower edge of said planar portion extending at least as far as a line projected along the inner surface of said branch member such that said baffle extends at least across said branch member outlet part, said arcuate portion extending across the interior of said body portion, the lower end of said arcuate portion being attached to the upper edge of said planar portion, the upper edge of said arcuate portion being attached to the inner wall of said body portion between said outlet port and said sink strainer engaging end, whereby said baffle deflects downwardly the hot waste water from the dishwasher and dissipates the heat, thus protecting the body portion of said tail piece from damage.

2. The branch tail piece according to claim 1 wherein the cross-sectional area of the outlet end of said channeled flow path is at least as great as the internal cross-sectional area of said branch member.

3. The branch tail piece according to claim 1 wherein said branch member is inclined to said body portion such that the angle, as measured from said sink strainer engaging end, formed between the axis of said branch member and the axis of said body portion is less than 90°.

4. The branch tail piece according to claim 1 wherein said tail piece is constructed of a resinous material.

5. The branch tail piece according to claim 1 wherein said means for coupling said tail piece to the waste water outlet of the dishwasher or the like comprises a plurality of nut engaging threads.

6. The branch tail piece according to claim 1 wherein said means for coupling said tail piece to the waste water outlet of the dishwasher or the like comprises a plurality of spaced integral annular sealing ribs.

7. The branch tail piece according to claim 1 wherein said means for coupling said tail piece to the sink strainer comprises a plurality of nut engaging threads.

8. The branch tail piece according to claim 1 wherein said means for coupling said tail piece to the sink strainer comprises force fit means for engaging a captured nut, said force fit means having an annular shoulder circumferentially positioned adjacent said sink strainer engaging end of said tail piece and an annular groove circumferentially inscribed within said shoulder.

9. The branch tail piece according to claim 1 wherein said branch member is located adjacent said sink strainer engaging end of said tail piece.

10. The branch tail piece according to claim 1 wherein said body portion, said branch member and said baffle are of unitary construction.

11. A waste water drainage system comprising in combination, a sink strainer for draining waste water from a sink, conduit means for conducting waste water from a dishwasher or the like, a trap associated with a waste drain, and a branch tail piece comprising a hollow tubular body portion, a hollow tubular branch member, and a baffle, said body portion having an upper sink strainer engaging end including means for coupling said tail piece to said sink strainer and a lower trap engaging end adapted to engage said trap, said branch member extending outwardly from said body portion and having an inlet port and an outlet port, said outlet port communicating with the interior of said body portion, said branch member including means for coupling said inlet port to said conduit means, said baffle being positioned within said body portion adjacent said outlet port to provide a channeled flow path for directing the flow of the waste water within said tail piece to prevent the waste water from being expelled from said sink strainer, said baffle comprising a planar portion and an arcuate portion, said planar portion extending chordwise across the interior of said body portion, the lower edge of said planar portion extending at least as far as a line projected along the inner surface of said branch member such that said baffle extends at least as far as a line projected along the inner surface of said branch member such that said baffle extends at least across said branch member outlet part, said arcuate portion extending across the interior of said body portion, the lower end of said arcuate portion being attached to the upper edge of said planar portion, the upper edge of said arcuate portion being attached to the inner wall of said body portion between said outlet port and said sink strainer engaging end, whereby said baffle deflects downwardly the hot waste water from the dishwasher and dissipates the heat, thus protecting the body portion of said tail piece from damage.

* * * * *